US010823046B2

(12) United States Patent
Ferrari et al.

(10) Patent No.: US 10,823,046 B2
(45) Date of Patent: Nov. 3, 2020

(54) TWO-STROKE INTERNAL COMBUSTION ENGINE

(71) Applicant: EMAK S.P.A., Bagnolo In Piano (RE) (IT)

(72) Inventors: Marco Ferrari, Carpi (IT); Vincenzo Gagliardi, Modena (IT)

(73) Assignee: EMAK S.P.A., Bagnolo in Piano (RE) (IT)

( * ) Notice: Subject to any disclaimer, the term of this patent is extended or adjusted under 35 U.S.C. 154(b) by 0 days.

(21) Appl. No.: 16/308,018

(22) PCT Filed: May 30, 2017

(86) PCT No.: PCT/IB2017/053161
§ 371 (c)(1),
(2) Date: Dec. 7, 2018

(87) PCT Pub. No.: WO2017/216665
PCT Pub. Date: Dec. 21, 2017

(65) Prior Publication Data

US 2019/0257240 A1 Aug. 22, 2019

(30) Foreign Application Priority Data

Jun. 14, 2016 (IT) ..... 102016000061120

(51) Int. Cl.
*F02B 25/20* (2006.01)
*F02B 75/02* (2006.01)
*F02F 3/24* (2006.01)

(52) U.S. Cl.
CPC ..... *F02B 25/20* (2013.01); *F02B 75/02* (2013.01); *F02F 3/24* (2013.01); *F02B 2075/025* (2013.01)

(58) Field of Classification Search
CPC .... F02B 25/20; F02B 75/02; F02B 2075/025; F02F 3/24
See application file for complete search history.

(56) References Cited

U.S. PATENT DOCUMENTS 5,628,295 A 5/1997 Todero et al.
6,367,431 B1 * 4/2002 Nemoto ..... F02B 25/14 123/65 P (Continued)

FOREIGN PATENT DOCUMENTS

EP 1069294 A2 1/2001
EP 2348208 A2 7/2011
JP H11287124 A 10/1999

*Primary Examiner* — Joseph J Dallo
*Assistant Examiner* — Kurt Philip Liethen
(74) *Attorney, Agent, or Firm* — Volpe Koenig

(57) ABSTRACT

A two-stroke internal combustion engine includes: a piston-cylinder group defining a combustion and a pumping chamber, the piston mobile in the cylinder between a bottom dead center where the combustion chamber's volume is maximum and the pumping chamber's volume is minimum, and a top dead center, where the combustion chamber's volume is minimum and the pumping chamber's volume is maximum. The engine also includes an intake conduit communicating with the pumping chamber, an exhaust conduit communicating with the combustion chamber, at least a pair of transfer conduits allowing communication between the pumping and combustion chambers, and at least two primary channels in the piston, individually provided with an inlet facing onto the exhaust conduit and an outlet facing on a respective transfer conduit at least when the piston is at the top dead center. A lateral surface of the piston includes a lowering where the primary channels inlets are located.

8 Claims, 3 Drawing Sheets

(56) References Cited

U.S. PATENT DOCUMENTS

| | | | | |
|---|---|---|---|---|
| 6,662,765 | B2 * | 12/2003 | Araki | F02B 33/04 123/73 A |
| 7,025,021 | B1 * | 4/2006 | Andersson | F02B 25/14 123/65 W |
| 7,082,910 | B2 * | 8/2006 | Carlsson | F02B 25/14 123/65 P |
| 8,714,122 | B2 * | 5/2014 | Yamazaki | F02B 25/22 123/73 AA |
| 9,938,926 | B2 * | 4/2018 | Yamazaki | F02B 25/14 |
| 2008/0302344 | A1 * | 12/2008 | Kunert | F02B 25/14 123/73 PP |
| 2012/0060806 | A1 | 3/2012 | Kunert | |

* cited by examiner

TWO-STROKE INTERNAL COMBUSTION ENGINE

TECHNICAL FIELD

The present invention relates to a two-stroke internal combustion engine.

In particular the invention relates to an internal combustion engine provided with a recycling system of the uncombusted fuel expelled with the exhaust gases.

PRIOR ART

Two-stroke internal combustion engines are characterised by high specific power and constructional simplicity, which makes them particularly suitable for use in mobile tools for work in the care of vegetation, such as for example chain saws, brush cutters and lawn mowers.

Two-stroke internal combustion engines generally comprise a base in which a crankshaft is fashioned, i.e. a chamber able to contain the crankshaft of the engine, and a head fixed superiorly to the base.

Internally of the engine head at least a straight cylinder is fashioned, which in the lower part thereof flows into the crank chamber.

A piston is free to slide internally of the cylinder, which separates a combustion chamber, defined internally of the cylinder, from a pumping chamber, defined internally of the crank chamber.

The piston is connected to the crankshaft by means of a con rod and is mobile in the cylinder between a bottom dead centre, in which the volume of the combustion chamber is maximum and the volume of the pumping chamber is minimum, and a top dead centre, in which the volume of the combustion chamber is minimum and the volume of the pumping chamber is maximum.

An intake conduit is generally fashioned in the head or the base, through which a fresh charge of combustible fuel mixture enters the engine, in the specific case the pumping chamber, through an appropriately fashioned port known as the intake port.

From the pumping chamber the fresh charge can reach the combustion chamber through transfer conduits, fashioned in the head, which open into the cylinder through specially shaped ports, known as transfer ports.

The engine is also provided with an exhaust conduit, fashioned in the head of the engine, which enables evacuation of the combustion products and has an inlet port fashioned in the cylinder, on the opposite side with respect to the intake conduit, known as the exhaust port.

In the functioning of a two-stroke engine such as the one described in the foregoing, when the piston is at the top dead centre the intake port is open and the fresh charge enters the pumping chamber, while the transfer and exhaust ports are closed.

As the piston is at the top dead centre, the combustion of the fresh charge is under way and the gases, as they expand, push the piston towards the bottom dead centre, which piston, during the descent thereof, first opens the exhaust port and then the transfer port, while it contemporaneously closes the intake port.

In this way the exhaust gases exit from the exhaust conduit while the mixture present in the pumping chamber reaches the combustion chamber through the transfer conduits.

Once the bottom dead centre has been reached, the piston recommences rising towards the top dead centre, going to compress the gases present in the combustion chamber and going to close first the transfer port and then the exhaust port.

Since for a certain lapse of time both the transfer ports and the exhaust port are open, and for another lapse of time the exhaust port is open while the piston is rising towards the top dead centre, compressing the just-aspirated mixture, it can happen that a part of the fresh charge is expelled together with the exhaust gases.

This loss of a fresh charge is configurable as both a loss of unused fuel and, especially, a serious health risk for whoever breathes the non-combusted fuel present in the exhaust gases, such as for example the user of the chainsaw or the brush-cutter or the lawn mower.

A solution for this drawback includes fashioning, on the flank of the piston, a pair of connecting channels, each of which is provided with an inlet hole able to face the exhaust conduit, and an outlet hole able to face a respective transfer conduit.

In this way, when the piston is in the environs of the top dead centre, the connecting channels place the exhaust conduit in fluid communication with the transfer conduits, so that the difference of pressure in the conduits generates a flow of exhaust gases from the exhaust conduit towards the transfer conduit, which causes a part of the uncombusted fuel to re-enter the engine, where it mixes with the new and fresh charge.

A known problem of this solution is that the connecting channels are difficult to realise, as they must be made on the external cylindrical surface of the piston, which has a rather accentuated curvature.

In the specific case, this drawback means that the connecting channels have to be realised with a rather modest inclination, in this way also limiting the position of the transfer conduits with respect to the exhaust conduit.

An aim of the present invention is to obviate the above-mentioned design drawbacks of the prior art, with a solution that is simple, rational and relatively inexpensive.

The aims are attained by the characteristics of the invention as reported in the independent claim. The dependent claims delineate preferred and/or particularly advantageous aspects of the invention.

DESCRIPTION OF THE INVENTION

In particular, the invention discloses a two-stroke internal combustion engine comprising: a piston-cylinder group defining a combustion chamber and a pumping chamber, the piston being mobile in the cylinder between a bottom dead centre, in which the volume of the combustion chamber is maximum and the volume of the pumping chamber is minimum, and a top dead centre, wherein the volume of the combustion chamber is minimum and the volume of the pumping chamber is maximum, an intake conduit communicating with the pumping chamber, an exhaust conduit communicating with the combustion chamber, at least a pair of transfer conduits able to set the pumping chamber in communication with the combustion chamber, at least two primary channels fashioned in the piston and individually provided with an inlet which faces onto the exhaust conduit and an outlet which faces onto a respective transfer conduit at least when the piston is at the top dead centre; where a lateral surface of the piston comprises a lowering in which the inlets of the primary channels are located.

With this lowering, the realising of the channels for the recycling of the uncombusted fuel is advantageously simplified.

In a further aspect of the invention, the primary channels are inclined with respect to a median plane containing the longitudinal axis of the piston, in particular, the median plane is perpendicular to a rotation axis of a crank coupled to the piston.

In this way the channels for recycling the uncombusted fuel can effectively place the exhaust conduit with the transfer conduits in communication.

In a further aspect of the invention, each primary channel is inclined with respect to the median plane by an angle comprised between 40° and 60°, preferably 50°.

With this solution it is possible to position the transfer conduits at a relatively short distance from the exhaust conduit.

In a further aspect of the invention, the primary channels are symmetrical with respect to the median plane.

In this way a good overall balancing of the inertia forces of the piston is guaranteed.

In a further aspect of the invention, the engine comprises two further transfer conduits able to place the pumping chamber in communication with the combustion chamber, the piston comprising a pair of secondary channels, each of which branches from a primary channel and has an outlet facing a respective conduit of the further transfer conduits.

In this way an engine is provided having four transfer conduits, and is therefore more efficient in a fluid-dynamic way than an engine with only two transfer conduits.

In a further aspect of the invention, the primary channels and the secondary channels are straight.

With this solution, the primary and secondary conduits are easier to manufacture.

In a further aspect of the invention, the lowering is configured so as to place the channels in communication with the exhaust conduit substantially between 40° of crank before the top dead centre and 40° of crank after the top dead centre In this way the conduits are configured so as to enter into function in the operating interval of the engine in which the percentage of uncombusted fuel present in the exhaust gases is greater, i.e. during the operating interval in which the greater quantity of the fuel can be recycled.

BRIEF DESCRIPTION OF THE DRAWINGS

Further characteristics and advantages of the invention will emerge from a reading of the following description, provided by way of non-limiting example with the aid of the figures illustrated in the appended tables of drawings.

BEST WAY OF CARRYING OUT THE INVENTION

Figure 1:
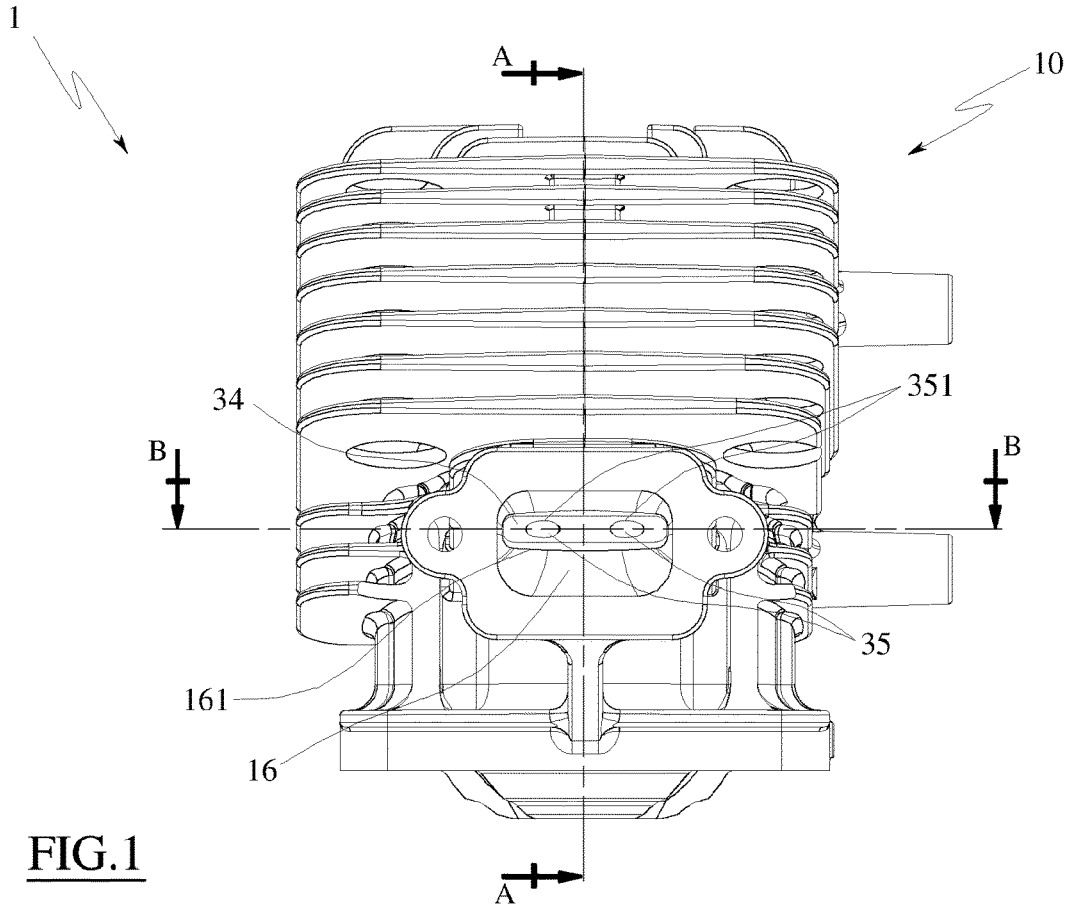
FIG. 1 is a lateral view of the two-stroke engine of the invention.
Figure 2:
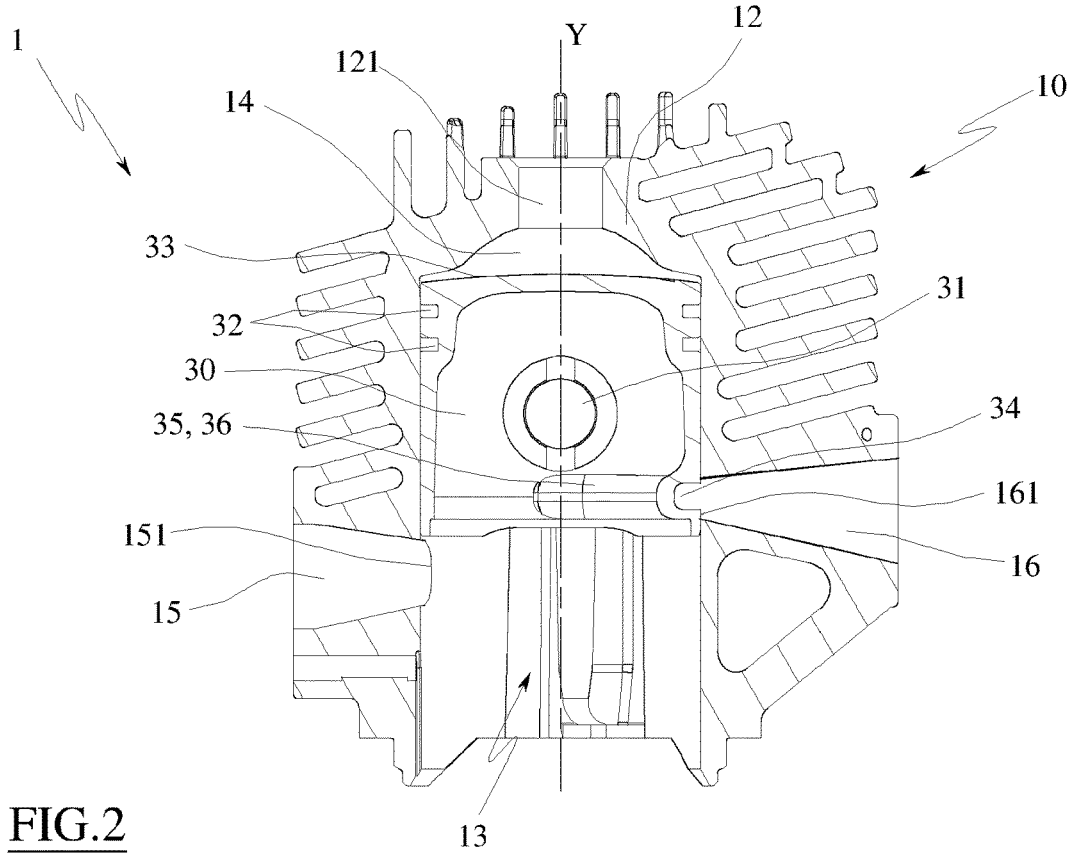
FIG. 2 is a section view along section plane A-A of the two-stroke engine illustrated in FIG. 1.

With particular reference to the figures of the drawings, reference numeral 1 denotes in its entirety a two-stroke internal combustion engine which is supplied by a gaseous mixture composed of air, fuel and lubricating fluid.

The engine 1 comprises a base provided with a crank chamber configured for containing and supporting in rotation a crankshaft, i.e. a drive shaft to which a crank is solid in rotation (these components are not illustrated in the figures). The engine 1 also comprises a head 10, typically finned, which is fixed solidly to the base.

A hollow cylinder 11 is fashioned internally of the head 10, which has an open end open at the portion thereof facing onto the base while the other end is closed by a wall 12 of the head 10.

A piston 30 is slidably associated internally of the cylinder 11, defining a pumping chamber 13, defined by the union of the volume of the crank chamber with the volume of the cylinder portion 11 comprised between the piston 30 and the crank chamber, and a combustion chamber 14 defined by the volume of the portion of cylinder 11 comprised between the wall 12 and the piston 30.

The piston 30 is hinged to the crank by means of a con rod (not illustrated) and is activated to slide between a bottom dead centre, in which the volume of the combustion chamber 14 is maximum and the volume of the pumping chamber 13 is minimum, and an upper dead centre, in which the volume of the combustion chamber 14 is minimum and the volume of the pumping chamber 13 is maximum.

The special characteristics of the piston 30 will be described in the following in greater detail.

The wall 12 of the head 10 includes a seating 121 configured for housing a spark plug (not shown in the figures) able to set off the combustion of the mixture present in the combustion chamber 14. The seating 15 can be constituted for example by a threaded through-hole having a central axis that is parallel to the longitudinal axis of the cylinder.

The engine 1 further comprises an intake conduit 15 fashioned in the head 10, though which the fuel mixture is injected into the pumping chamber 13.

The intake conduit 15 is provided with an intake port 151 configured so as to be totally occluded by the piston 30 when the piston is in the environs of the bottom dead centre.

The intake conduit 15 has a longitudinal axis that is substantially perpendicular to the longitudinal axis Y of the piston 30.

The intake conduit 15 also has a transversal section that grows going from the intake port 151 towards the outside of the head 10.

The engine 1 further comprises an exhaust conduit 16 through which the products of the combustion are evacuated.

The exhaust conduit 16 is fashioned in a portion of the head 10, diametrically opposite with respect to the intake conduit 14, and is provided with an exhaust port 161, which is positioned at a greater height than the intake port 151 with respect to the bottom dead centre of the piston 30 and is configured so that when the lower portion of the piston 30 is superposed on the exhaust port 161, the intake port 151 is completely free of the piston 30.

The exhaust conduit 16 has a longitudinal axis that is substantially perpendicular to the longitudinal axis Y of the piston 10 and has a diverging profile going from the exhaust port 161 to externally of the head 10.

Figure 3:
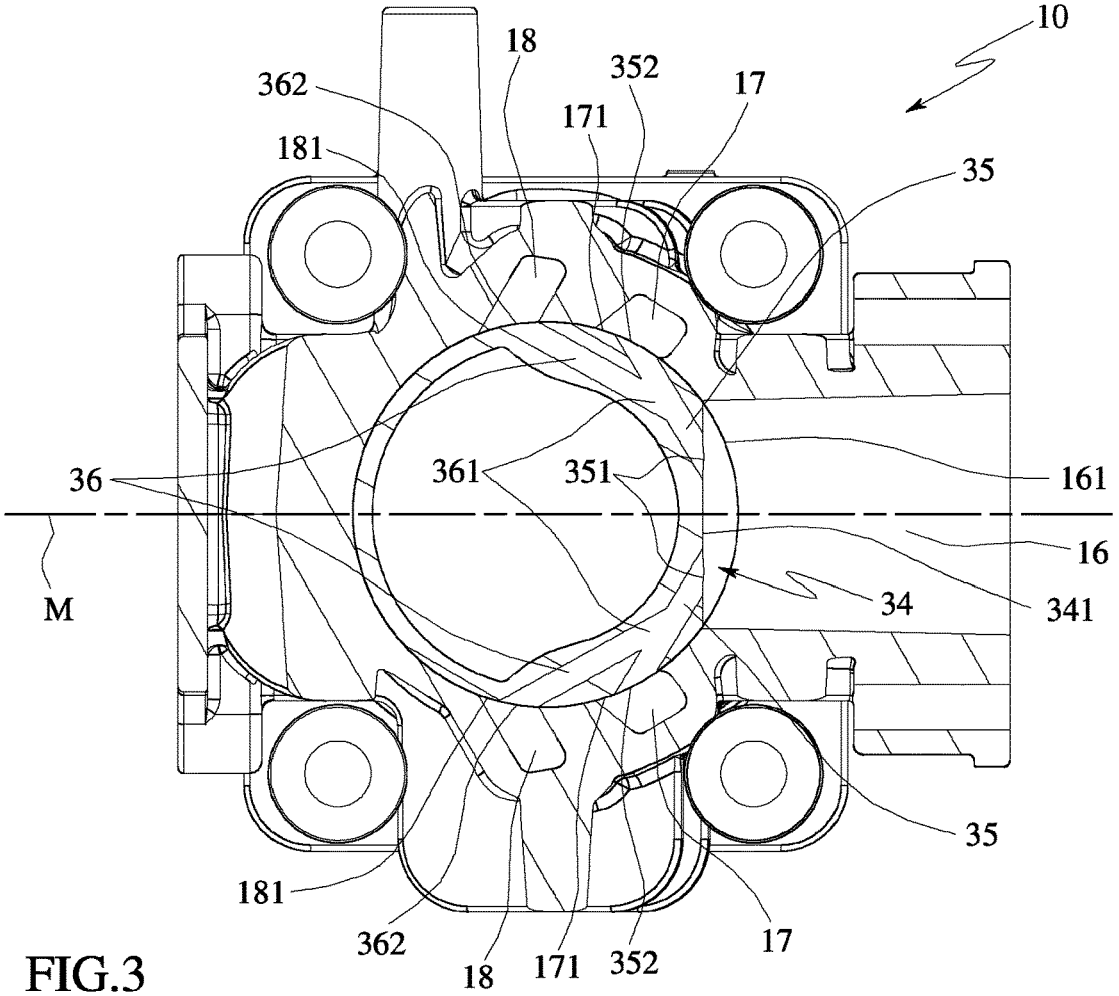
FIG. 3 is a section view along section plane B-B of the two-stroke engine illustrated in FIG. 1.
Figure 4:
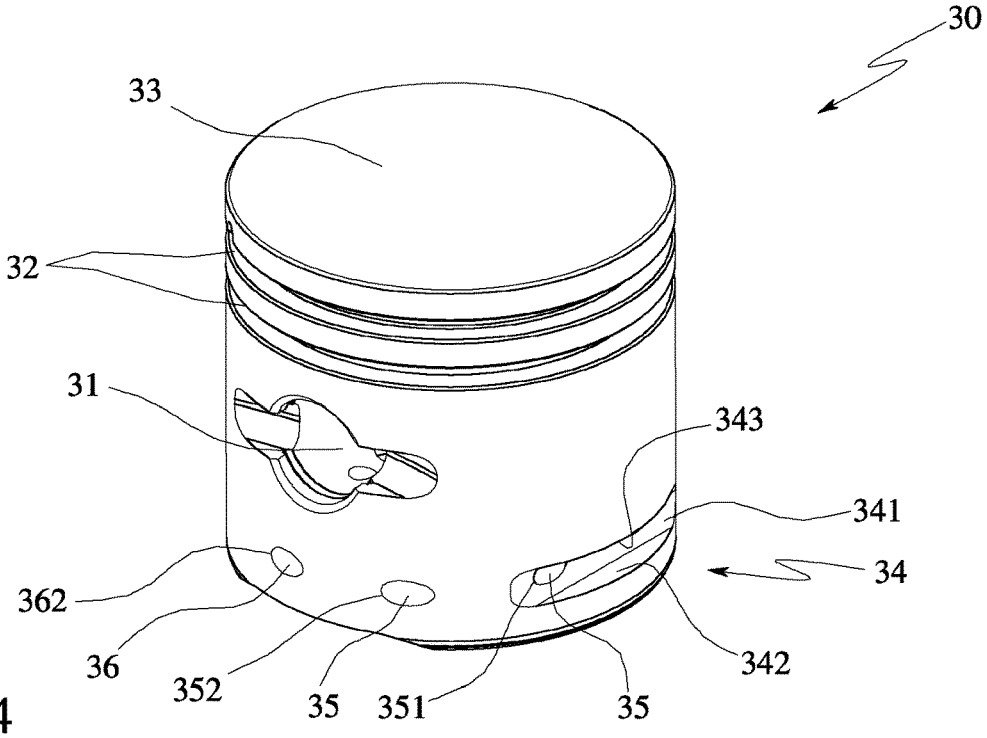
FIG. 4 is a perspective view of the piston according to the invention.
Figure 5:
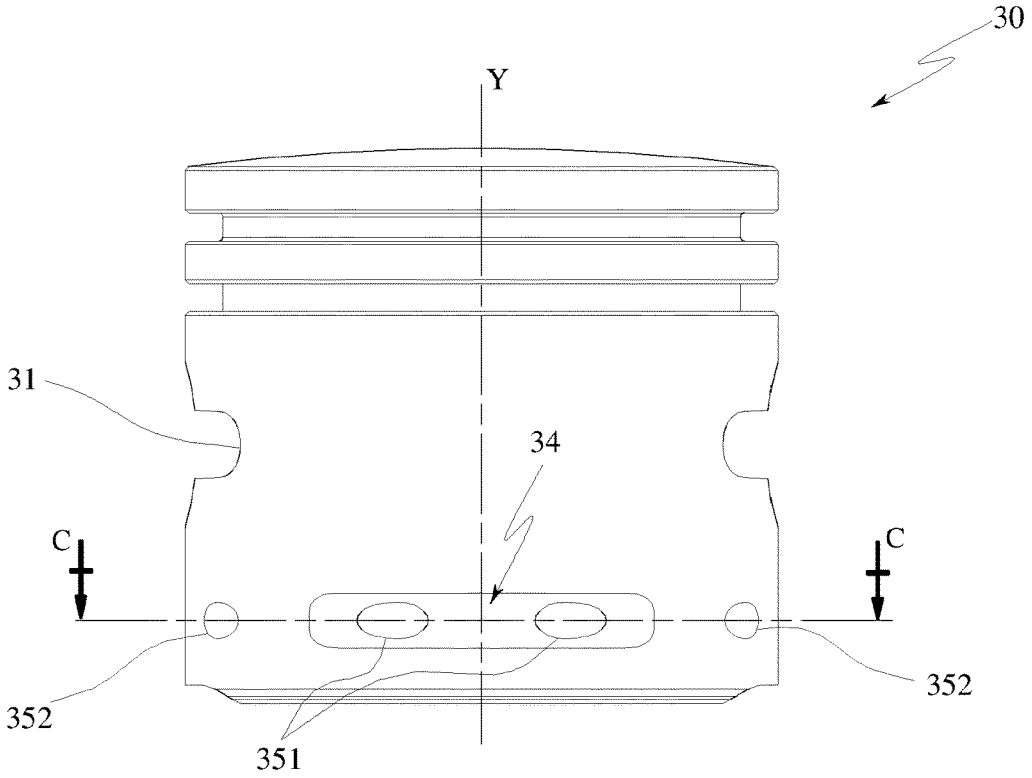
FIG. 5 is a lateral view of the piston of FIG. 4.
Figure 6:
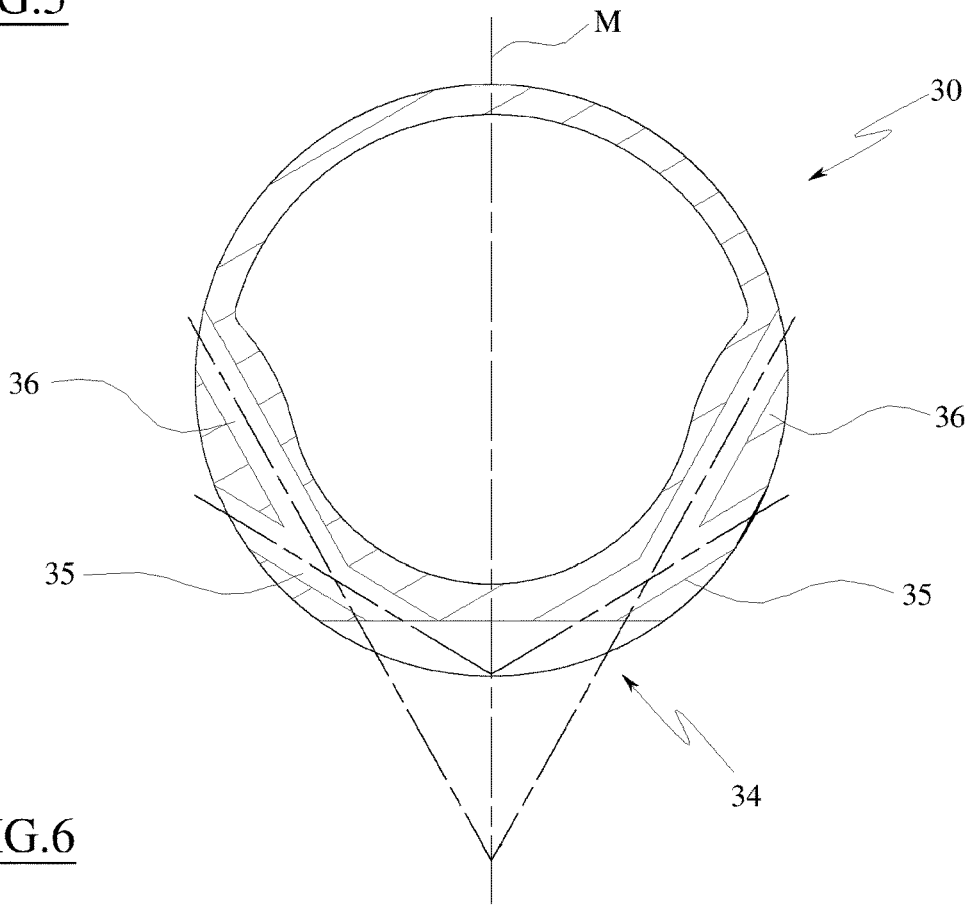
FIG. 6 is a section view along section plane C-C of the piston illustrated in FIG. 5.

As can be seen in FIG. 3, the engine 1 is further provided with at least a pair of transfer conduits 17, fashioned in diametrically opposite portions of the head 10 and able to place the pumping chamber 13 in communication with the combustion chamber 14.

The engine 1 preferably comprises two pairs of transfer conduits 17, 18, fashioned in diametrically opposite portions of the head 10 and able to place the pumping chamber 13 in communication with the combustion chamber 14. The transfer conduits 17, 18 are provided with relative transfer ports 171, 181 which face onto the combustion chamber 14 and have a central axis positioned substantially at the same height as the longitudinal axis of the exhaust 16.

As previously mentioned, the engine 1 comprises the piston 30 which is slidably associated to the cylinder 11.

The piston 30 comprises a cylindrical seating 31, internally of which a plug is inserted (not illustrated in the figures) enabling coupling of the piston 30 with the con rod, a pair of circumferential seatings 32, positioned in the upper portion of the piston 30 and able each to house an elastic seal band (not illustrated), and a top 33 having a convex shape.

The piston 30 further comprises a lowering 34 fashioned on the flank of the piston 30, in the lower portion thereof, and facing onto the exhaust conduit 16 when the piston 30 is in the environs of the top dead centre.

The lowering 34 comprises a flat bottom wall 341 lying on a plane that is substantially perpendicular to the rotation axis of the crank.

The bottom wall 341 has a dimension in the perpendicular direction to the longitudinal axis Y of the piston 30 that is substantially equal to the dimension in the same direction of the exhaust port 161.

The lowering 43 further comprises a lower wall 342 squared with the bottom wall 341 and able to inferiorly delimit the lowering 43, and an upper wall 343 squared with the bottom wall 341 and able to superiorly delimit the lowering 43.

The distance between the lower wall 342 and the upper wall 343, i.e. the dimension of the lowering 34 in the direction of the longitudinal axis Y of the piston 30, is substantially 0.65 times the dimension of the exhaust port 161 in the direction of the longitudinal axis Y of the piston 30.

In practice, the lowering 43 can be embodied as a milling made on the lateral surface of the piston 30.

The piston 30 is further provided with two primary channels 35 fashioned in the lower portion of the piston 30, each of which is provided with an inlet 351, fashioned in the bottom wall 341 of the lowering 34, and an outlet 352, fashioned in a portion of the lateral surface of the piston 30, which faces onto a respective transfer conduit 17.

The primary channels 35 have a longitudinal axis that is substantially straight and lying on a plane that is perpendicular to the longitudinal axis Y of the piston 30, and are arranged symmetrically with respect to a median plane M containing the longitudinal axis Y of the piston 30 and perpendicular to the rotation axis of the crank.

Specifically, each primary channel 35 is inclined with respect to the median plane (M) by an angle comprised between 40° and 60°, preferably 50°. Further, the primary channels 35 have a transversal section that is circular and the area of the transversal section, constant along the whole longitudinal axis of the channel, is substantially 0.15 times the area of the exhaust port 161.

The piston 30 further comprises a pair of secondary channels 36, each of which branches from a respective primary channel 35.

In particular, each secondary channel 36 is provided with an inlet 361, fashioned in a portion of the wall of the respective primary channel 35, and an outlet 362, fashioned in a portion of the lateral surface of the piston 30, which faces onto a respective transfer conduit 18.

The secondary channels 36 have a longitudinal axis that is substantially straight and lying on a plane that is perpendicular to the longitudinal axis Y of the piston 30, and are arranged symmetrically with respect to a median plane M containing the longitudinal axis Y of the piston 30 and perpendicular to the rotation axis of the crank.

Each secondary channel 36 is inclined with respect to the median plane M by an angle comprised between 20° and 40°, preferably 30°.

Further, the secondary channels 36 have a transversal section that is circular and the area of the transversal section, constant along the whole longitudinal axis of the channel, is substantially 0.15 times the area of the exhaust port 161.

The functioning of the engine 1 according to the invention is the following.

Following the combustion of the mixture present in the combustion chamber 14, the piston 30, which is in the environs of the top dead centre, is pushed by the expansion of the combusted gases towards the bottom dead centre.

During the descent towards the bottom dead centre, the piston 30 first uncovers the exhaust port 161, through which the combusted gases begin to flow towards the exhaust conduit 16, and then the transfer ports 171, 181 are also uncovered. At the same time the intake port 151 is progressively closed. Again during the descent towards the bottom dead centre, the piston 30 reduces the volume of the pumping chamber 13, in which a fresh charge of mixture previously entered during the crank revolution, pushing the fresh charge through the transfer conduits 17 18 internally of the combustion chamber 14.

While the fresh charge of mixture is pumped into the combustion chamber 14, the exhaust conduit 16 is open and consequently part of the mixture is expelled without being used.

Once the bottom dead centre has been reached, the piston 30 recommences rising towards the top dead centre, going to compress the mixture present in the combustion chamber 14. During the rising of the piston 30 first the transfer ports 171, 181 are covered and then the exhaust port 161 is covered.

At the same time the intake port 151 is uncovered and the depression generated in the pumping chamber 13 by the rising of the piston 30 causes the intake of the fresh charge of mixture through the intake conduit 15.

As during the majority of the compression step of the fresh mixture the exhaust port 161 is open, further mixture is expelled into the exhaust conduit 16 without being combusted.

When the piston 30 completes the rise and is in the environs of the top dead centre, the lowering 34 is positioned in front of the exhaust port 161 and the outlets 352 and 362 of the channels 35, 36 are positioned in front of the transfer ports 171, 181.

In this way the exhaust conduit 16 is placed in fluid communication with the transfer conduits 17, 18 through the channels 35, 36.

Owing to the greater pressure present in the exhaust conduit 16 with respect to the transfer conduits 17, 18, part of the gases present in the exhaust conduit 16, between which a considerable percentage of uncombusted fuel is present, enter the transfer conduits 17, 18, passing through the channels 35, 36, thus reducing the percentage of uncombusted fuel expelled into the external environment.

The invention as it is conceived is susceptible to numerous modifications, all falling within the scope of the inventive concept.

Further, all the details can be replaced with other technically-equivalent elements.

In practice the materials used, as well as the contingent shapes and dimensions, can be any according to requirements, without forsaking the scope of protection of the following claims.

The invention claimed is:

1. A two-stroke internal combustion engine (1) comprising:

a piston-cylinder group defining a combustion chamber (14) and a pumping chamber (13), the piston (30) being mobile in the cylinder (11) between a bottom dead center, wherein the volume of the combustion chamber (14) is maximum and the volume of the pumping chamber (13) is minimum, and a top dead center, wherein the volume of the combustion chamber (14) is minimum and the volume of the pumping chamber (13) is maximum, an intake conduit (15) communicating with the pumping chamber (13), an exhaust conduit (16) communicating with the combustion chamber (14), at least a pair of transfer conduits (17) able to set the pumping chamber (13) in communication with the combustion chamber (14), and at least two primary channels (35) fashioned in the piston (30) and individually provided with an inlet (351) which faces onto the exhaust conduit (16) and an outlet (352) which faces on a respective transfer conduit (17) at least when the piston (30) is at the top dead center, wherein a lateral surface of the piston (30) comprises a lowering (34) in which the inlets (351) of the primary channels (35) are located, and wherein the lowering (34) faces onto the exhaust conduit (16) and thereby places the exhaust conduit (16) in fluid communication with the transfer conduits (17, 18) through the primary channels (35, 36), at least when the piston (30) is at the top dead center.

2. The engine (1) of claim 1, wherein the primary channels (35) are inclined with respect to a median plane (M) containing the longitudinal axis (Y) of the piston (30) and perpendicular to a rotation axis of a crank coupled to the piston (30).

3. The engine (1) of claim 2, wherein each primary channel (35) is inclined with respect to the median plane (M) by an angle comprised between 40° and 60°.

4. The engine (1) of claim 2, wherein the primary channels (35) are symmetrical with respect to the median plane (M).

5. The engine (1) of claim 1, further comprising two further transfer conduits (18) adapted to place the pumping chamber (13) in communication with the combustion chamber (14), the piston (30) comprising a pair of secondary channels (36), each of which branches from a primary channel (35) and has an outlet (362) facing a respective conduit of the further transfer conduits (18).

6. The engine (1) of claim 5, wherein the primary channels (35) and the secondary channels (36) are straight.

7. The engine (1) of claim 1, wherein the lowering (34) is configured so as to place the channels (35, 36) in communication with the exhaust conduit (16) between a 40° of crank position before the top dead center and 40° of crank position after the top dead center.

8. The engine (1) of claim 1, wherein the lowering (34) comprises a flat bottom wall (341) lying on a plane that is parallel to a longitudinal axis (Y) of the piston (30), the inlets (351) of the primary channels (35) being fashioned in the flat bottom wall (341) of the lowering (34).

* * * * *